US006435402B1

(12) United States Patent
Hengami

(10) Patent No.: US 6,435,402 B1
(45) Date of Patent: Aug. 20, 2002

(54) PACKAGE DESIGN

(76) Inventor: David Todjar Hengami, 4455 Torrance Blvd., #356, Torrance, CA (US) 90503

( * ) Notice: Subject to any disclaimer, the term of this patent is extended or adjusted under 35 U.S.C. 154(b) by 0 days.

(21) Appl. No.: 09/619,700

(22) Filed: Jul. 19, 2000

Related U.S. Application Data

(60) Provisional application No. 60/144,522, filed on Jul. 19, 1999.

(51) Int. Cl.[7] ..... B65D 5/486; B65D 77/04

(52) U.S. Cl. ..... 229/120.03; 229/117.3; 229/117.35; 229/120.18; 229/122; 229/129.1; 229/131.1

(58) Field of Search ..... 229/117.27, 117.28, 229/117.3, 117.31, 117.35, 120.03, 120.18, 121, 122, 125.12, 129.1, 131.1, 164.2, 242

(56) References Cited

U.S. PATENT DOCUMENTS

| | | | | | |
|---|---|---|---|---|---|
| 2,569,018 | A | * | 9/1951 | Priester | 229/120.18 |
| 2,983,421 | A | * | 5/1961 | Turpin | 229/121 |
| 4,081,128 | A | * | 3/1978 | O'Neill | 206/536 |
| 4,361,270 | A | * | 11/1982 | Roccaforte | 229/120.03 |
| 5,056,708 | A | * | 10/1991 | Boyle et al. | 229/120.03 |
| 5,348,219 | A | * | 9/1994 | Brintazzoli | 229/122 |
| 5,505,373 | A | * | 4/1996 | von Stillfried | 229/129.1 |

* cited by examiner

*Primary Examiner*—Gary E. Elkins
(74) *Attorney, Agent, or Firm*—Oppenheimer Wolff & Donnelly LLP

(57) ABSTRACT

A packaging system for storing and dispensing pourable items includes a box that has an opening. An inner liner inside the box has a removable portion defined by at least one line of weakness. The removable portion is positioned adjacent to the opening in the box. The packaging system has a first mode for longer term storage in which the removable portion remains intact to seal the inner liner, and a second mode for dispensing the contents of the inner liner through the opening in which the removable portion has been at least partially removed from the inner liner. In one embodiment, the box comprises a front wall having an opening and an inside surface, a back wall, a first and a second side wall, a top and a bottom flap, and a slide that is in contact with the inside surface of the front wall, the slide having an opening. The front wall, back wall, first and second side walls, and top and bottom flaps are interconnected so as to form a box, the slide being movable between an open position in which the slide opening substantially aligns with the front wall opening and a closed position in which the slide opening is entirely out of alignment with the front wall opening, thereby closing the box. A method of dispensing a pourable item includes forming a packaging system, removing the removable section from said inner liner, and pouring at least a portion of the contents of the inner liner through the opening in the box.

9 Claims, 17 Drawing Sheets

311
318
305
324
319
322
321
317
322
315
320
314
307
316
302
304
306
313
310
301

FIG. 11
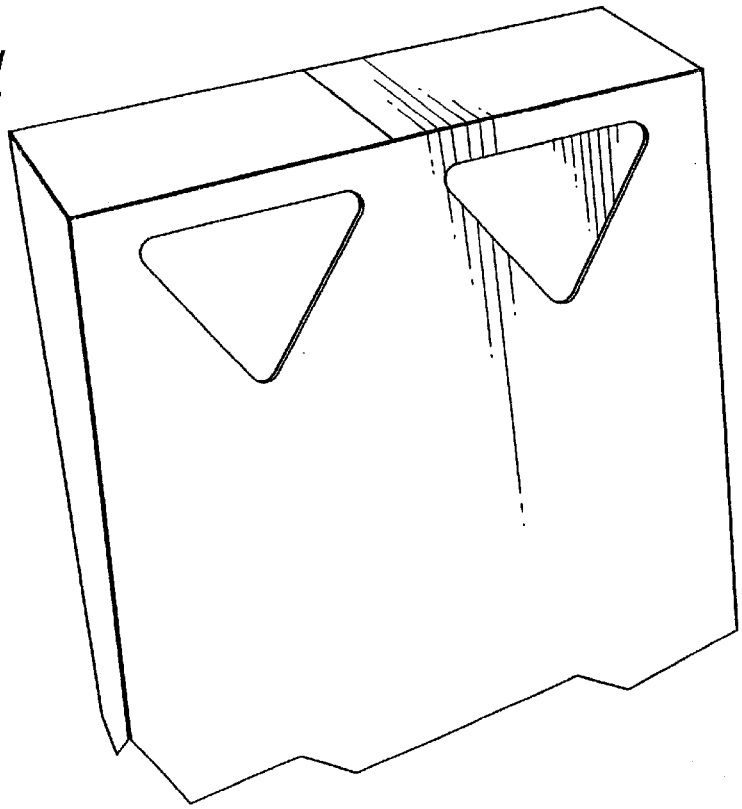
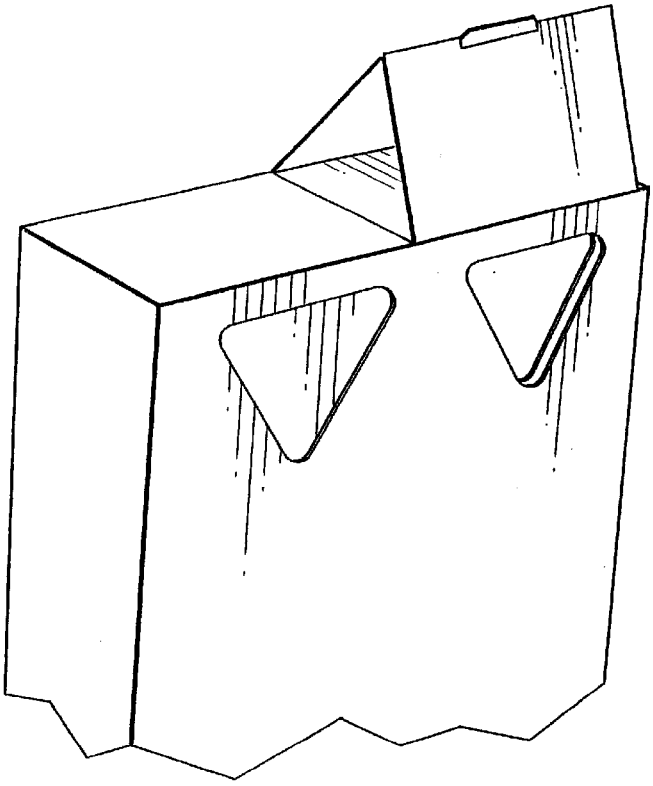
FIG. 12

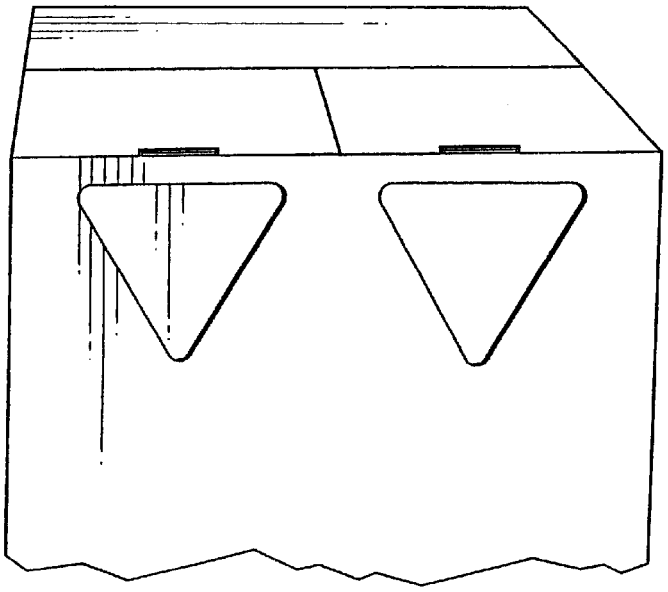
FIG. 23
FIG. 24
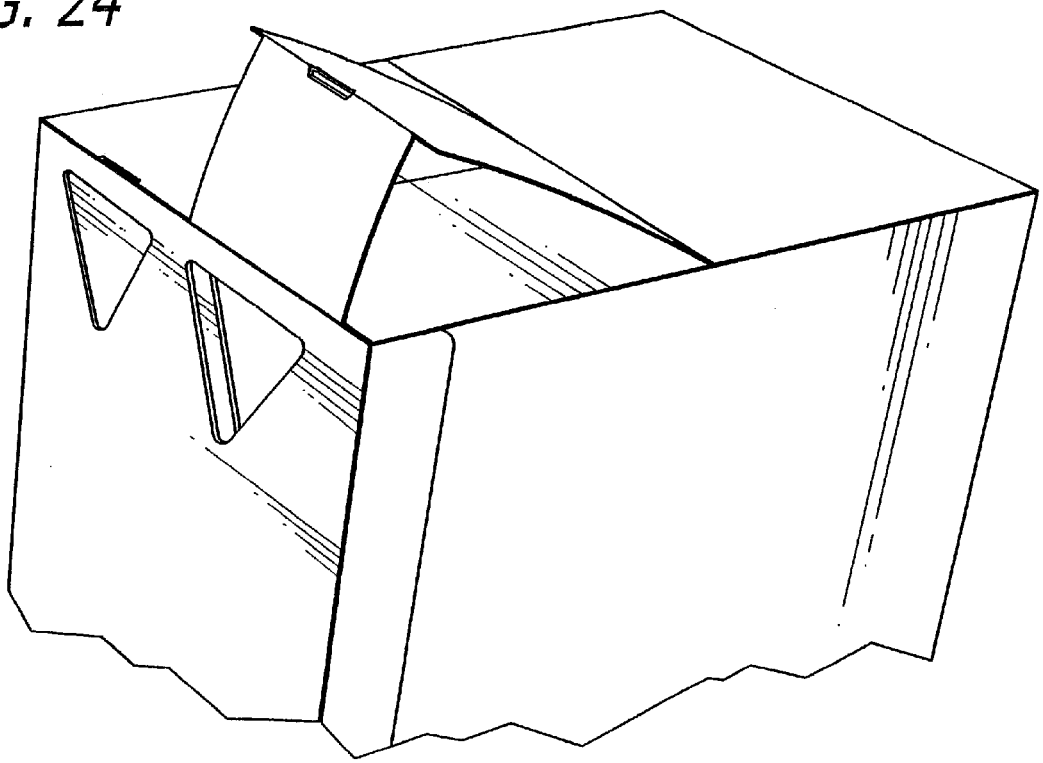

PACKAGE DESIGN

RELATED APPLICATION

This application claims priority under 35 USC 119(e) from U.S. Provisional Patent Application No. 60/144,522, which was filed on Jul. 19, 1999 and which is hereby incorporated by reference in its entirety.

BACKGROUND OF THE INVENTION

A. Field of the Invention

The present invention relates to the field of packaging and, in particular, to packaging for pourable food and other items.

B. Prior Art

A wide range of pourable products, such as candies, cereals, laundry soaps, and many other products, are dispensed in cardboard boxes. To access the contents, a user must generally open the top of the box. Sometimes the contents are held in a wax paper bag inside the box, and the bag must be opened as well. To store the contents, the user closes the bag and then closes the box.

U.S. Pat. No. 5,505,373 discloses a novel box for conveniently storing and dispensing pourable items. The box has a back wall and a slide connected to the back wall. The slide has a slide opening and two side tabs extending from the slide. A front wall with an opening is connected to the back wall. The box also has an interior supporting wall having first and second side slits. The slide is disposed within the box, with each of the tabs being inserted into a corresponding one of the slits. The box has an open position in which the openings are aligned and in which the contents of the box may be poured out. The box also has a closed position for storing the contents.

SUMMARY OF INVENTION

A packaging system for storing and dispensing pourable items has a box with an opening. An inner liner has a removable portion defined by at least one line of weakness, the removable portion being positioned adjacent to the opening in the box. The packaging system has a first mode for longer term storage in which the removable portion remains intact to seal the inner liner, and a second mode for dispensing the contents of the inner liner through the opening in which the removable portion has been at least partially removed from the inner liner.

In accordance with another aspect of the present invention, a box for conveniently storing and dispensing pourable items has a front wall having an opening and an inside surface, a back wall, a first and a second side wall, a top and a bottom flap, and a slide that is in contact with the inside surface of the front wall, the slide having an opening. The front wall, back wall, first and second side walls, and top and bottom flaps are interconnected to form a box. The slide is movable between an open position in which the slide opening substantially aligns with the front wall opening, and a closed position in which the slide opening is entirely out of alignment with the front wall opening, thereby closing the box. An inner liner inside the box has a removable area defined by one or more lines of weakness. The removable area is positioned adjacent to at least a portion of the front wall opening.

The one or more lines of weakness may be perforations, such as microperforations, or may be other lines of weakness such as scoring. The removable area may include a tab for convenient removal of the area from the inner liner. The inner liner may be a bag, a pouch, or other type of container for holding material. While in most embodiments the inner liner has thin, flexible walls made from such materials as wax paper, cellophane, metalized mylar or the like, in special embodiments the inner liner may have more thicker and/or more rigid walls.

In one embodiment of the present invention, the front wall comprises a plurality of front wall openings. The slide may have more than one opening, too, so that the contents of the box may be poured from more than one opening simultaneously. Alternatively, there may be a plurality of open positions in each of which at least one slide opening is in alignment with at least one front wall opening. The optional inner liner may also include a plurality of removable portions corresponding in position to the plurality of front wall openings on the box. The openings in the inner liner and the box may be of a wide variety of shapes and sizes.

In one embodiment of the invention, the box is formed of sulfite cellulose cardboard. In other embodiments, the box is formed of plastic, or from a variety of other materials that are suitable for making boxes.

A method of dispensing a pourable item from a box includes forming a packaging system in accordance with an embodiment of the present invention. The user moves the slide to the open position, then removes the removable portion of the inner liner. The user then pours at least a portion of the contents of the inner liner out of the box.

The present application addresses numerous other inventions, including alternative package designs that may be used with or without inner liners as described above. For example, the packages may have two or more independent openings. Separate slides may be provided for each of the openings, such that each opening may be open and/or shut independently of the other(s). The package may be provided with a stop so that the user cannot accidentally pull the slide(s) all the way out of the package by accident. That is, when the slide reaches the fully open position, the stop prevents the slide from opening further.

A multiple-opening package may have one or more compartment separators. With independent compartments, different products may be stored within the package. The user can open one opening to dispense one of the products, without opening the other opening(s) to dispense the other products.

In another alternative package design, the package may have two or more openings, with two or more corresponding inner liners within the package to store different products. When the inner liners are bags, the use of a compartment separator within the package is optional, since the bags themselves serve to keep the products separate.

Other features may be incorporated into the package design. The liner may have a removable portion, defined by one or more lines of weakness or by other means such as a removable sticker. The removable portion of the liner is aligned with the box opening.

The system can optionally include a cartridge, into which the liner is affixed, for insertion into the box. The cartridge serves to maintain the liner in the proper position within the box.

As another option, the system can include a sound module. As the box is opened, the sound module is activated. The sound module can play music, an advertising message, and/or any combination of sounds for that sound modules can generate.

In one particular embodiment of the invention, a system for conveniently storing and dispensing pourable items has a front wall with an opening and an inside surface, a back wall, a first and a second side wall, a top and a bottom flap and a slide that is in contact with the inside surface of the front wall, said slide having an opening. The front wall, back wall, first and second side walls, and top and bottom flaps are interconnected so as to form a box. The slide is movable between an open position in which the slide opening substantially aligns with the front wall opening and a closed position in which said slide opening is entirely out of alignment with the front wall opening, thereby closing the box. An inner liner inside said box has a removable area defined by one or more lines of weakness. The removable area is positioned adjacent to at least a portion of the front wall opening. The system also has a retaining cartridge for the inner liner. The package may have more than one opening and corresponding slide, in which case multiple inner liners and retaining cartridges may be used. Alternatively, a single retaining cartridge that retains multiple inner liners may be used.

Related embodiments may have one or more other features. The bag may include lines of weakness, which may be perforations. Alternatively, instead of lines of weakness, the bag may simply be made of a material through which the user can cut an opening with a knife or other cutting tool. The cartridge may have four sides, three sides, or even two sides. A one-sided cartridge is also possible. The system may include a liner retention band that typically extends about the cartridge, to hold the bag within the cartridge. The system may include a sound module. In one embodiment, the sound module is activated when the slide is lifted into the open position, to play sounds that have been stored within the module, such as voices, music and the like. In another embodiment, graphics are printed on the slide such that when the slide is in the closed position, the graphics are visible through the opening in box.

Other objects and features of the invention will become apparent from a review of the Detailed Description below, from the drawings, and from the claims.

BRIEF DESCRIPTION OF THE DRAWINGS

FIG. 11 illustrates an alternative package design in which the package has two separate compartments;

FIG. 12 illustrates the alternative package design of FIG. 11 in which one of the slides has been raised to open one opening of the package;

FIG. 23 is a front view of another dual-opening package, with both slides in a lowered configuration such that both openings are closed;

FIG. 24 is a side perspective view of the package of FIG. 23, with one of the slides raised to open the corresponding opening;

DETAILED DESCRIPTION OF THE PREFERRED EMBODIMENT

Figure 1:
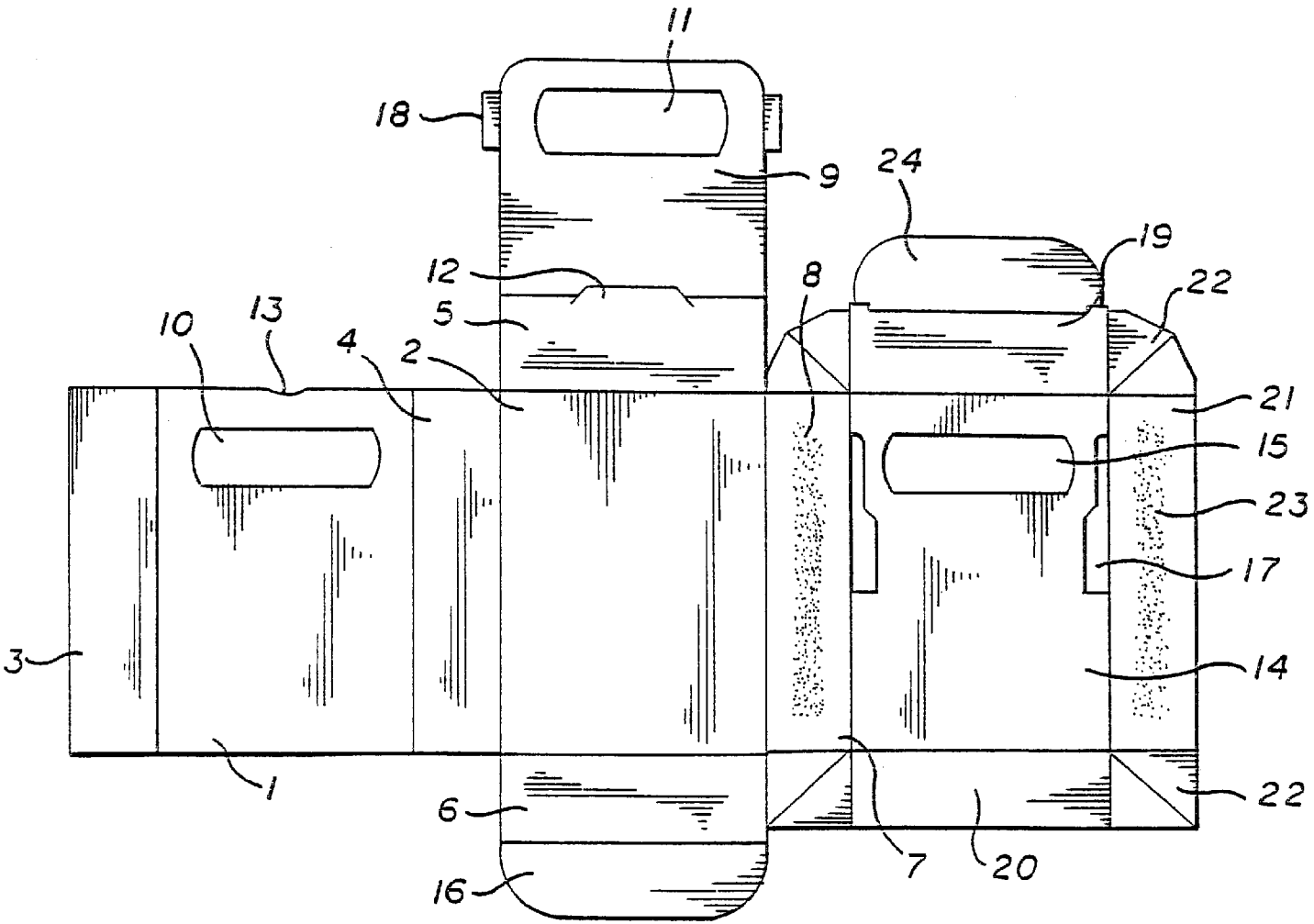
FIG. 1 (PRIOR ART)
FIG. 1 illustrates a blank from which a box according to the present invention is formed.

The box formed from the blank according to FIG. 1 has six outer walls, namely a front wall 1 and a back wall 2, a first side wall 3 and a second side wall 4 and a top flap 5 and a bottom flap 6. Between two of these walls the cross-section has folding lines F that define the edges of the finished box. A partition 7 is connected to the back wall 2 by a folding line. Partition 7 has a coating 8 of adhesive to bond the partition to the inside surface of the first side wall 3.

A bottom tongue 16 is connected to the bottom flap and its outside surface is in contact with the inside surface of front wall 1 when the box is completely assembled. A slide 9 is connected to the top flap 5 by a folding line and its outside surface is also in contact with the inside surface of front wall 1 when the box is fully assembled.

Front wall 1 has an opening 10. A corresponding slide opening 11 with a matching shape is provided in slide 9. When the top flap 5 is raised by thumb flap 12, slide 9 is raised along the inside surface of front wall 1 so the slide opening 11 comes to cover the opening 10 in front wall 1. Now the pourable product can be poured or shaken out of the box through the corresponding openings in the front wall 1 and slide 9. When pressure is applied from above to push the top flap 5 of the slide 9 down behind the front wall 1, the unperforated section of slide 9 closes off the opening 10 in the front wall. A recess 13 that facilitates the engagement of thumb flap 12 is provided in the front wall 1 in order to make it easier to open the box.

A supporting wall 14 is connected to the partition 7. When the box has been fully assembled, the supporting wall is on the inside next to the front wall 1. It has essentially the same dimensions as the front wall 1, and specifically it has an opening 15 which corresponds to the opening 10 in the front wall when the box is fully assembled.

The slide 9 is between the front wall 1 and the supporting wall 14 when the box is assembled, as is the lower tongue 16 that is connected to the bottom flap 6. The supporting wall 14 has two slits 17. The two straps 18 that project at a right angle from the slide in the direction of the interior of the box after the box has been assembled engage into these two slits. This forms a stop that defines the position of the slide 9 with regard to the supporting wall 14 and the front wall 1 when the box is open and prevents the slide from pulling out of the space between front wall 1 and supporting wall 14.

A top inner wall 19, a bottom inner wall 20 and a side inner wall 21 are attached to the side wall 14. There are four corner flaps 22, each arranged in a corner between the inner walls and the partition. The corner flaps are attached to the neighboring walls by fold lines, and another fold line divides each corner flap into two parts, so the corner flaps are folded into the inside of the box when the box is assembled.

The inner side wall 21 has an adhesive coating 23 for bonding it to the inside surface of the second side wall 4.

When the box is assembled, the bottom inner wall 20 is beneath the bottom flap 6 and the top inner wall 19 is beneath the top flap 5. The top tongue 24 that is attached to the top inner wall 19 is in contact with the inner surface of the back wall 2. The top inner wall 19 seals the box at the top, even when the top flap 5 is raised in order to open the box at openings 10, 11 and 15 by lifting the slide.

The blank of FIG. 1 is preferably die cut or laser cut from a sheet of material such as light cardboard or other material suitable for forming a box. The blank may be scored at fold lines to facilitate easily folding the blank into a box. The box is typically secured together with one of the adhesives that is conventional in the art.

Figure 3:
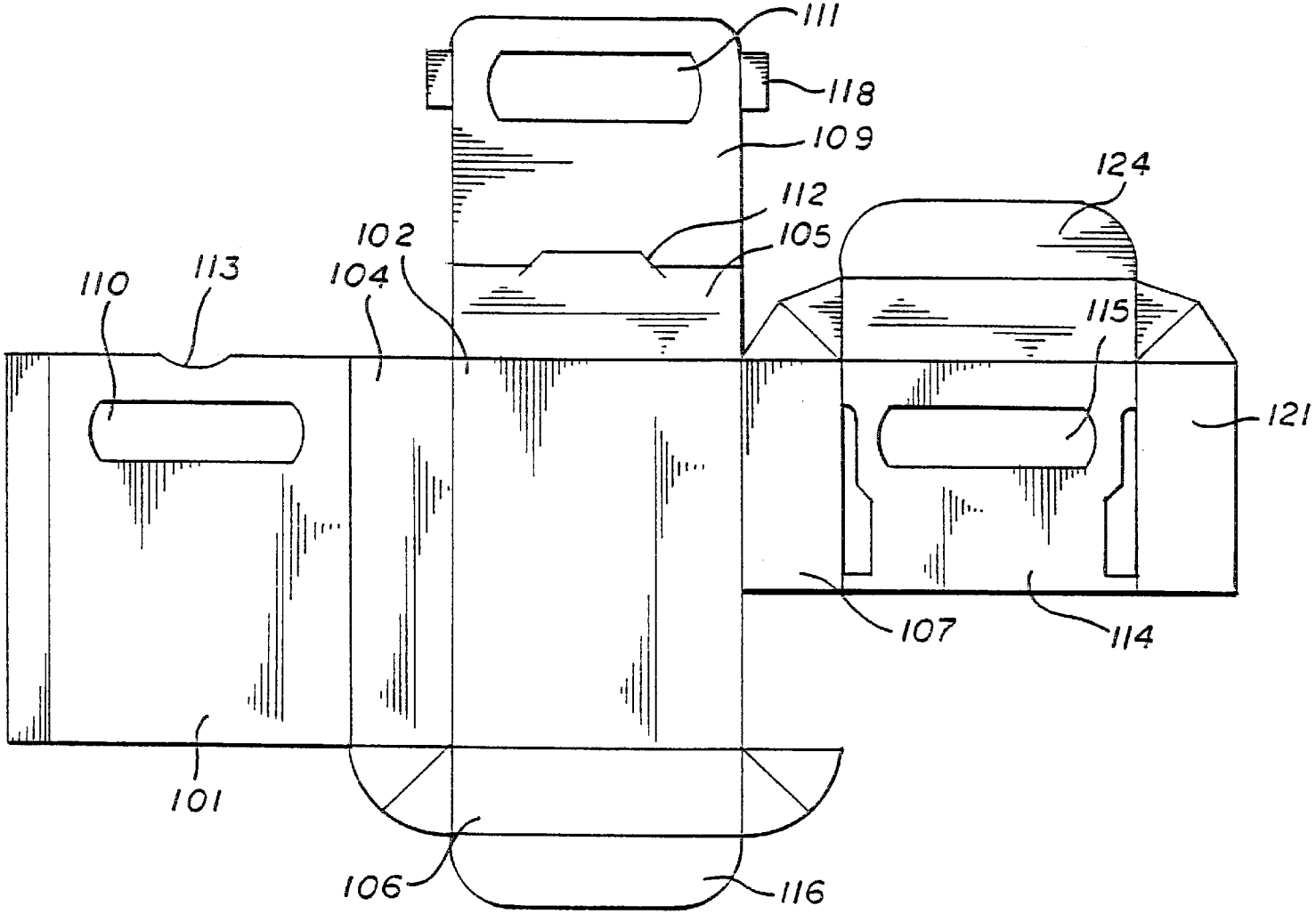
FIG. 3 illustrates a blank from which an alternative embodiment of the present invention is formed.

FIG. 3 illustrates an alternative design that requires somewhat less material to construct. The components of the design are numbered consistently with the components of FIG. 1, with the numbering increased by 100. The supporting wall 114 is somewhat shorter than the supporting wall 14 in FIG. 1. The partition 107 may also be somewhat shorter than the partition 7 in FIG. 1. In the embodiment of FIG. 1, there is a side wall 3 that the embodiment of FIG. 3 does not include, for the purpose of further saving material.

In FIG. 3, the supporting wall 114, the partition 107, and the inner side wall 121 are approximately one-half the length (or other shortened length) of corresponding wall 14, partition 7 and inner side wall 21 in FIG. 1. When hundreds of thousands or millions of the same box are produced, the shortened walls and partition can result in a large savings of material and reduced production costs. Eliminating the side wall 3 of FIG. 1 can further reduce the material and cost requirements.

Figure 4:
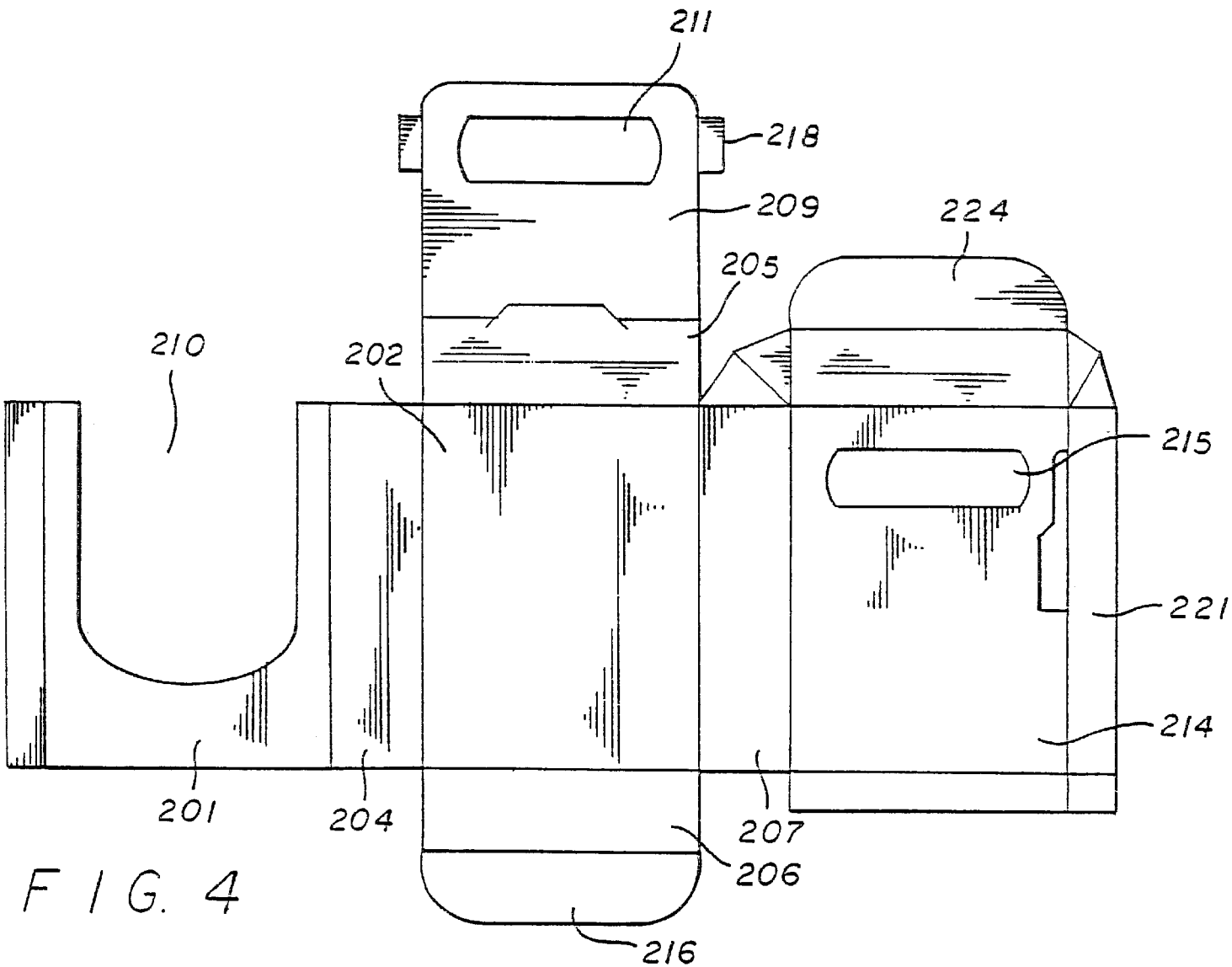
FIG. 4 illustrates a blank from which another alternative embodiment of the present invention is formed.

FIG. 4 illustrates a further alternative design. The components of the design are numbered consistently with the components of FIG. 1, with the numbering increased by 200. In this embodiment, the opening 210 is substantially larger than the corresponding opening 10 in the embodiment of FIG. 1. To further save material, the height of the supporting wall 214, inner side wall 221 and partition 207 can be reduced as in FIG. 3. Alternatively, the inner side 221 and supporting wall 214 can be eliminated entirely. To form the box, the front wall 201 would then be connected to partition 207, which could be provided with an extension to which front wall 201 could be adhered. Bottom tongue 216 could also be eliminated.

Figure 5:
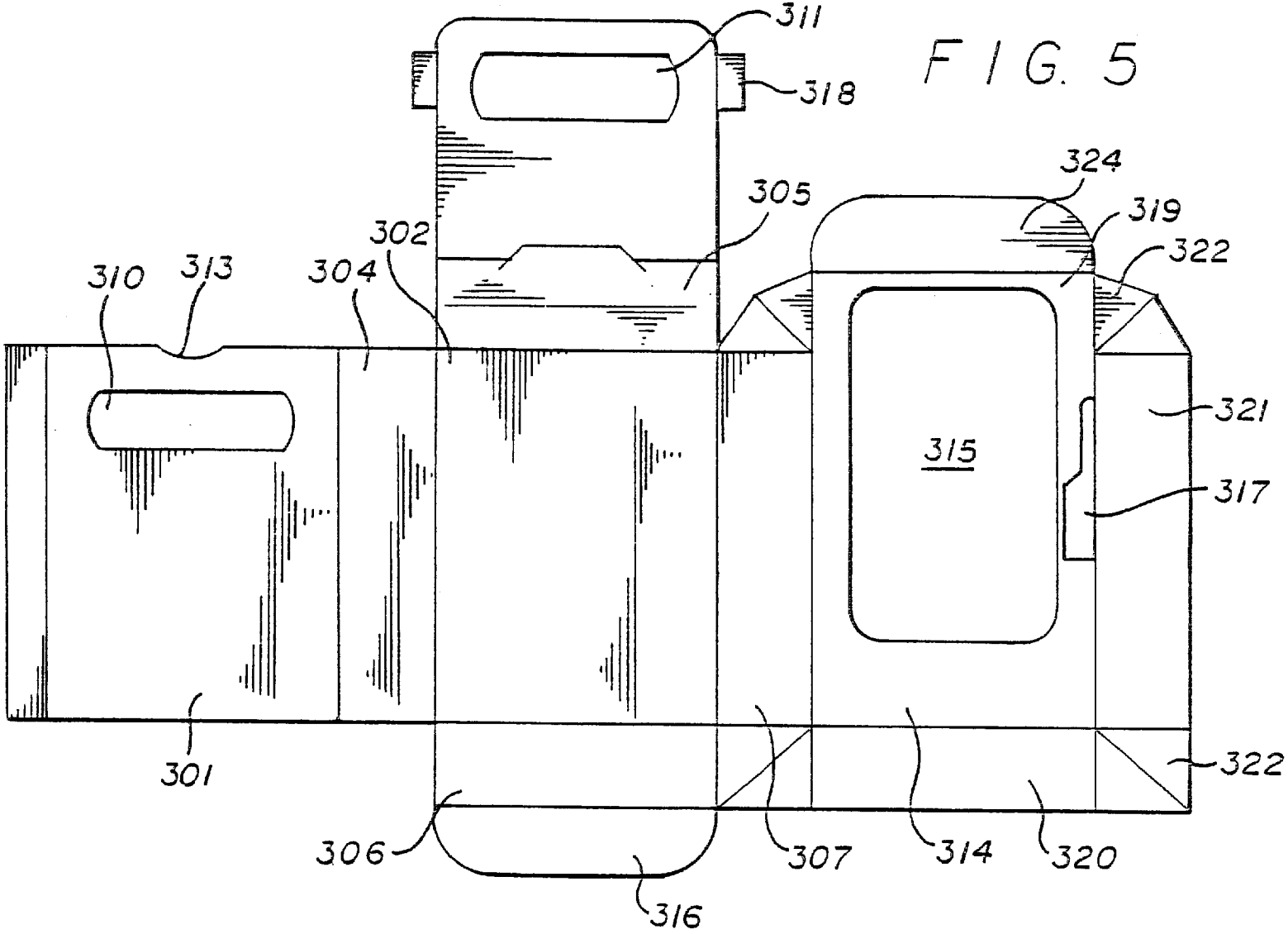
FIG. 5 illustrates a blank from which a further alternative embodiment of the present invention is formed.

FIG. 5 illustrates a further alternative design in which the opening 315 is enlarged in order to save material. The opening 315 extends into the top inner wall 319, and below the midpoint of the supporting wall 314. The first side wall 3 of FIG. 1 is also eliminated. The tabs 318 are optional and, if eliminated, the slits 317 may also be eliminated.

Material may be added or reduced from the box designs depending on the type of pourable product that is to be stored in the box. For example, the box may require more rigidity in order to store heavier items such as rice or some candies. Consequently, the design of FIG. 1 may be preferred over the design of FIG. 4 or FIG. 5 for use with certain products. On the other hand, lighter items, such as popcorn, dried pastas, and many other light weight products, may be stored in a box requiring less material than the design of FIG. 1.

Various embodiments of the present invention may be used in conjunction with a bag that fits inside the box. The general concept of bags within a box is conventional. For example, cereal is generally stored inside a wax paper or cellophane bag that the user opens from the top in order to pour the cereal from the box.

Figure 6:
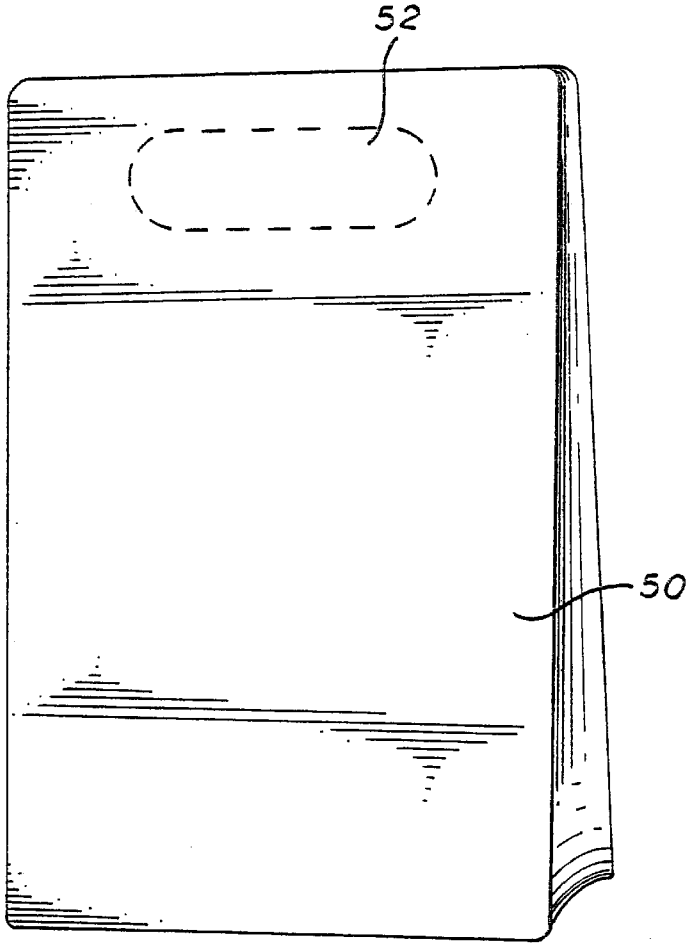
FIG. 6 illustrates one embodiment of an inner liner according to the present invention.
Figure 2:
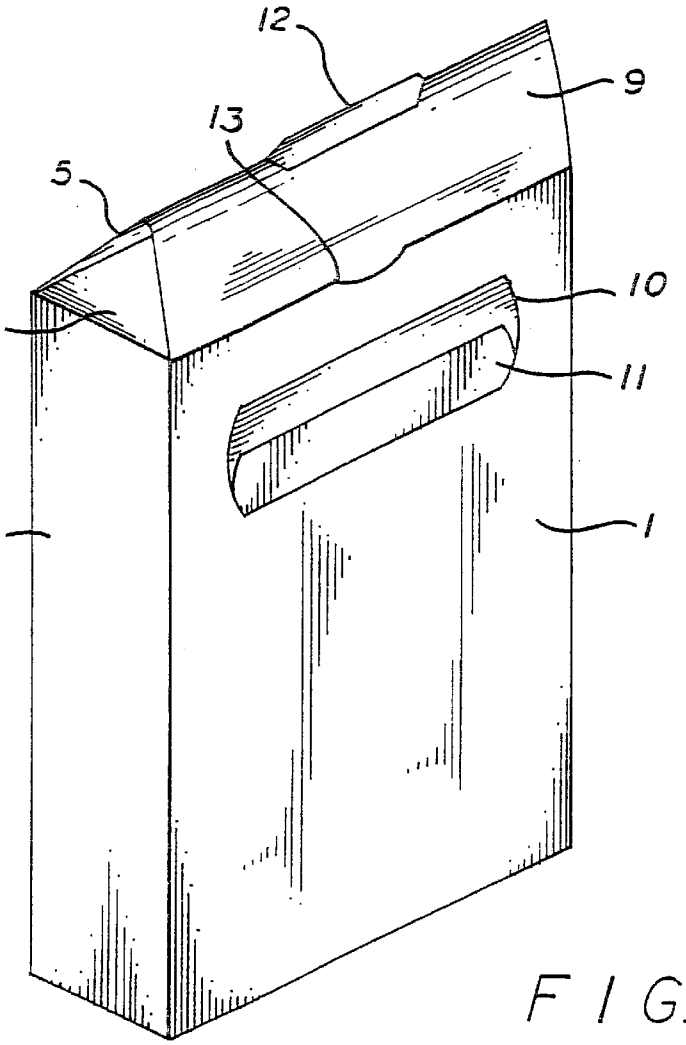
FIG. 2 (PRIOR ART)
FIG. 2 is a perspective view of the box designed from the blank of FIG. 1 in a half-opened state.

FIG. 6 illustrates a bag 50 having a perforated area 52. The perforated area 52 is positioned to correspond with the box opening 10, for example, in FIG. 2. Referring to FIG. 2, to open the bag, the user slides the slide 9 into the open position. The user then opens the bag 50 by reaching through the box opening 10, grasping the perforated area of the bag 52, and removing the area of the bag defined by perforations 54. The bag is then open, and the user can pour contents of the bag 50 through the now-opened portion of the bag, and out of the box through the opening 10.

In the presently preferred embodiment of the bag 50, the perforated area 52 is defined by microperforations, which are fine perforations that leave a relatively smooth edge after separation. However, alternatively, other types of perforations may be used. As an alternative to perforations, other forms of weakening may be employed, such as scoring.

As a further alternative, the bag 50 may be provided with an aperture. A sticker that is backed with a removable adhesive is applied to the bag 50 to seal off the aperture. To open the bag, the user removes the sticker from the aperture, so that the user may pour contents of the bag through the bag aperture and out the box aperture when the box is in the open position. The sticker may have a preprinted design and/or indicia on one or both surfaces. The bag may be provided with a release coating such as silicone to facilitate easy removal of the sticker. Alternatively, the bag may be constructed of a material from which the sticker may be peeled without a release coating. To reseal the bag, the user may replace the sticker on the bag. Alternatively, the user may seal the opening of the box itself with the sticker.

Figure 7:
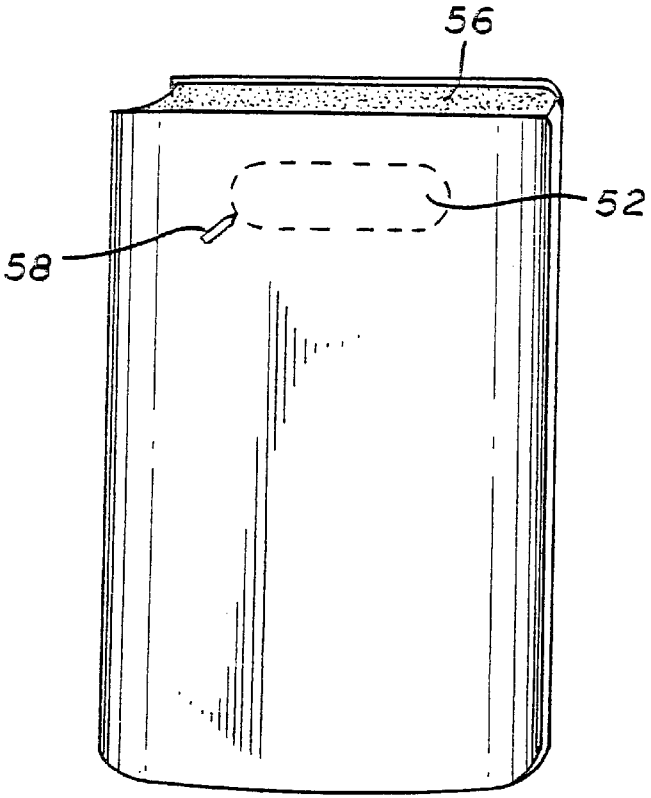
FIG. 7 illustrates an alternative embodiment of the inner liner of FIG. 6.

The bag 50 may be adhered to the interior of the box in order to ensure that the bag opening remains aligned with the box opening 10. In one embodiment, the top of the bag 56 (FIG. 7) is adhered to the top interior of the box. The bag may also be adhered to the side of the box or, in some embodiments, may be adhered to the bottom of the box, or may be otherwise secured within the box so that the bag opening aligns with the box opening in the open position. In one embodiment, the bag is glued to the interior of the box immediately adjacent to the box opening, so that the bag opening is held in alignment with the box opening.

The perforated area 52 may optionally be connected to a tab 58 to simplify opening the bag. When the box is open, the user may reach through the box opening 10, grasp the tab 58, and pull the tab in order to remove the area 52 from the bag. The tab 58 may be made of the same material as the bag or, alternatively, may be made of a different material. The tab 58 may be formed integrally with the bag as, for example, by simply die-cutting a tab out the portion 52. However, the tab 58 is preferably a separate member that is attached to the area 52 by conventional means.

Figure 8:
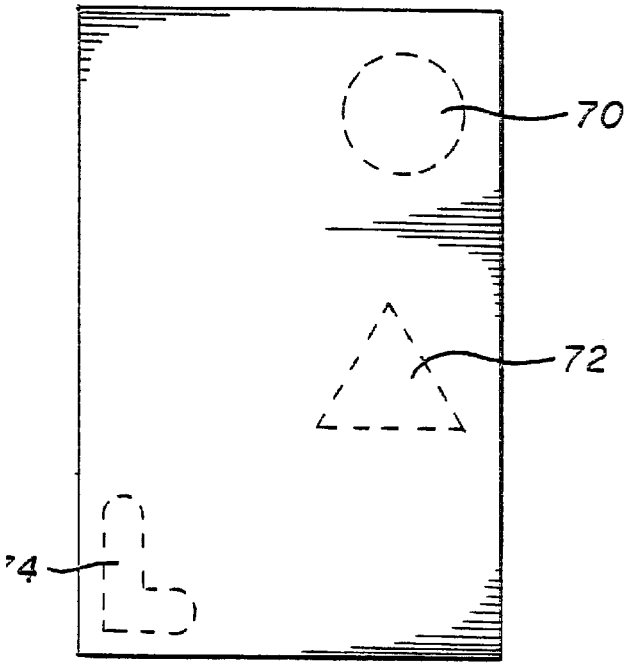
FIG. 8 is a view of one side of a box according to the present invention having more than one front opening.

The foregoing has described a presently preferred embodiment of the invention, as well as alternative embodiments. However, it should be understood that the scope of the invention is not limited to what is described in the Detailed Description. Numerous variations may be employed within the scope of the invention. For example, referring to FIG. 1, the opening 10 may be located at various other positions on the box. Referring to FIG. 8, the opening may be moved to an upper corner, to one side of the center, and/or to a lower corner. Any other position on the front is possible. The slide opening 11 (FIG. 1) should be located on the slide so as to be out of alignment with the box opening when in the closed position, and aligned with the box opening in the open position, so that the user can open and close the box opening by sliding the slide.

Figure 10:
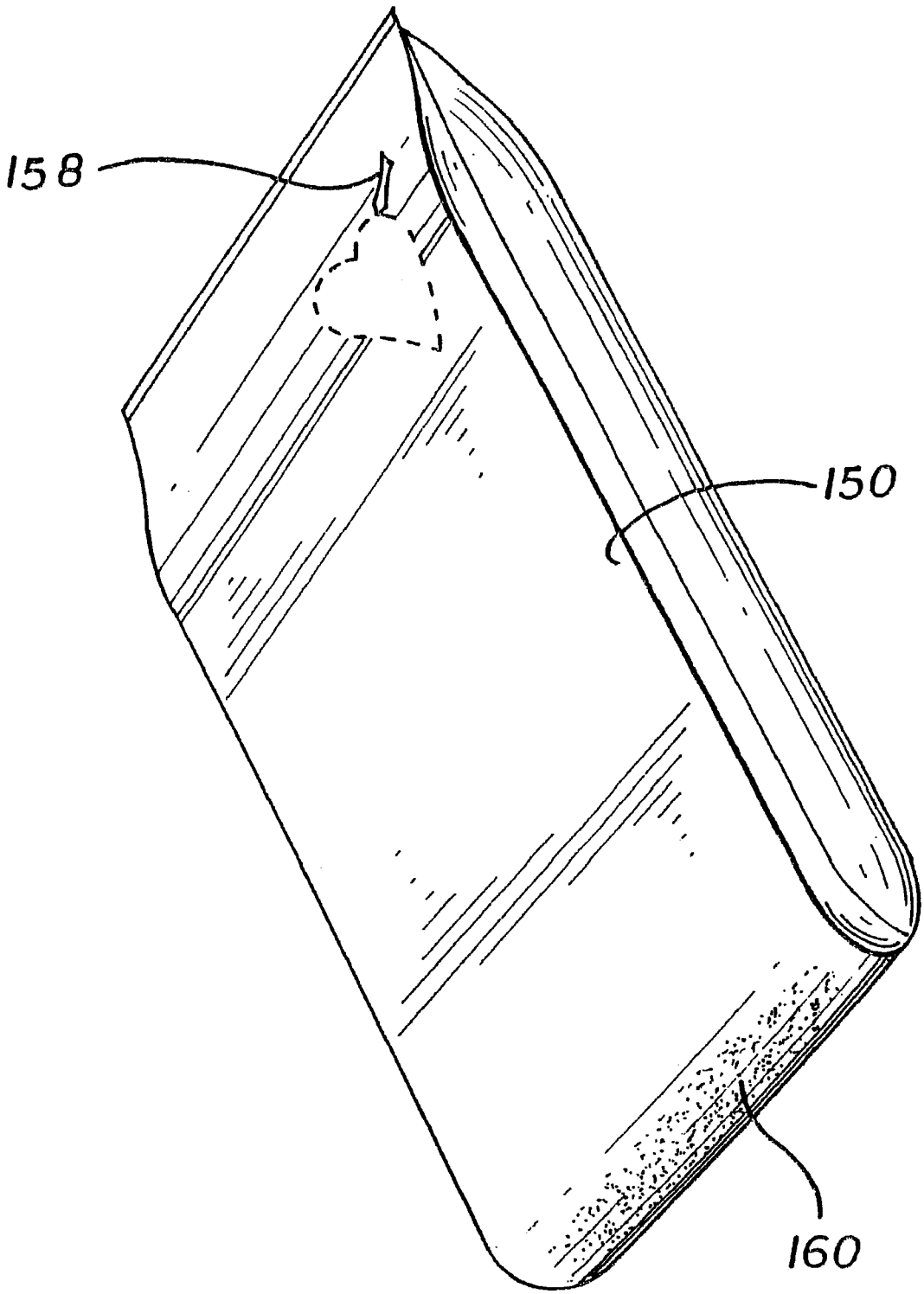
FIG. 10 illustrates a bag that is compatible with the box formed from the blank of FIG. 9, in which the perforated removable portion of the bag is heart-shaped to correspond with the heart-shaped opening of the box.
Figure 13:
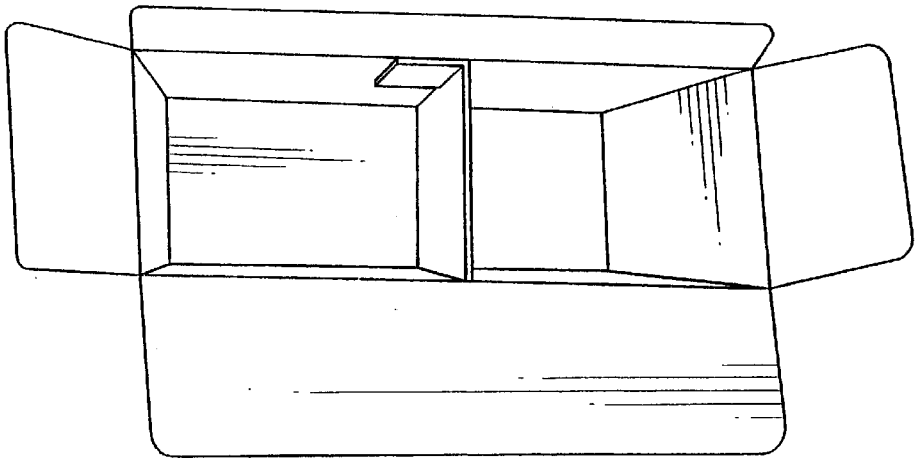
FIG. 13 illustrates the interior of the package of FIG. 11, showing that there are two compartments within the package that are separated by a divider.
Figure 14:
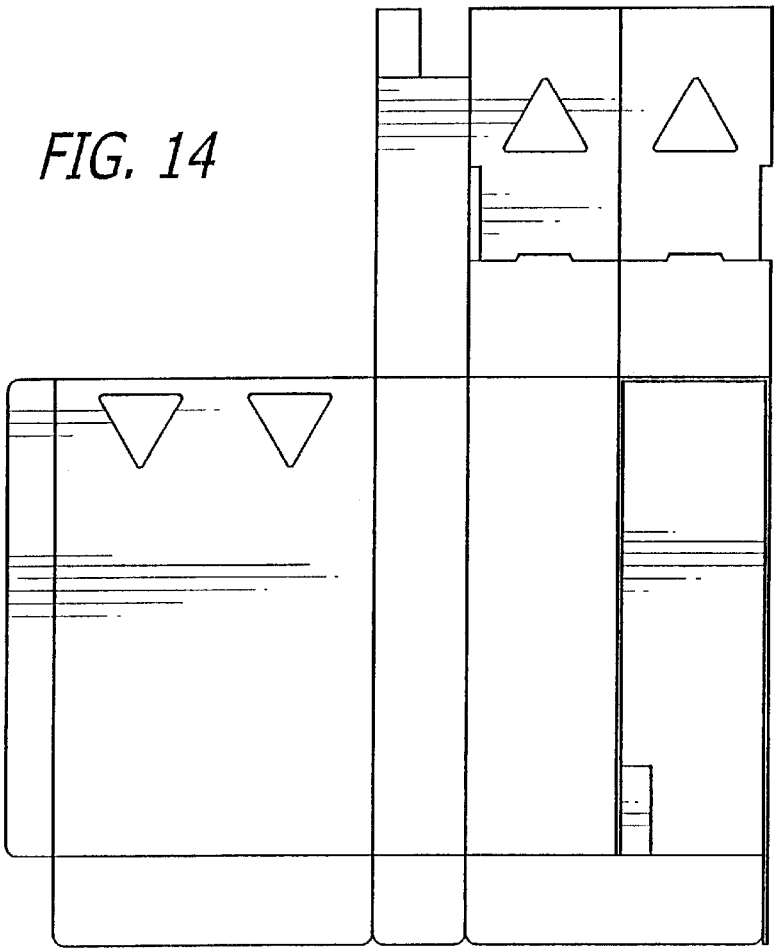
FIG. 14 illustrates a package blank that is to folded into the package of FIG. 11, with the compartment divider already having been folded into position.
Figure 15:
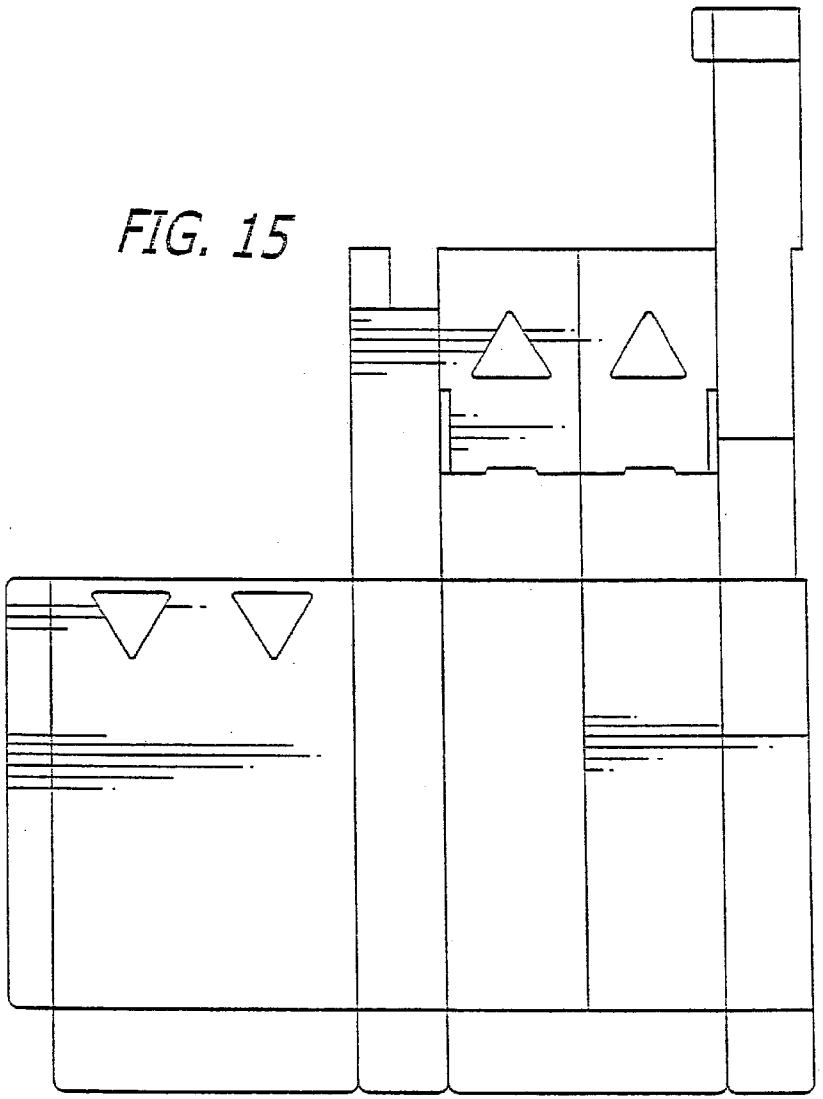
FIG. 15 illustrates the package blank of FIG. 14, before the compartment divider is folded into position.
Figure 16:
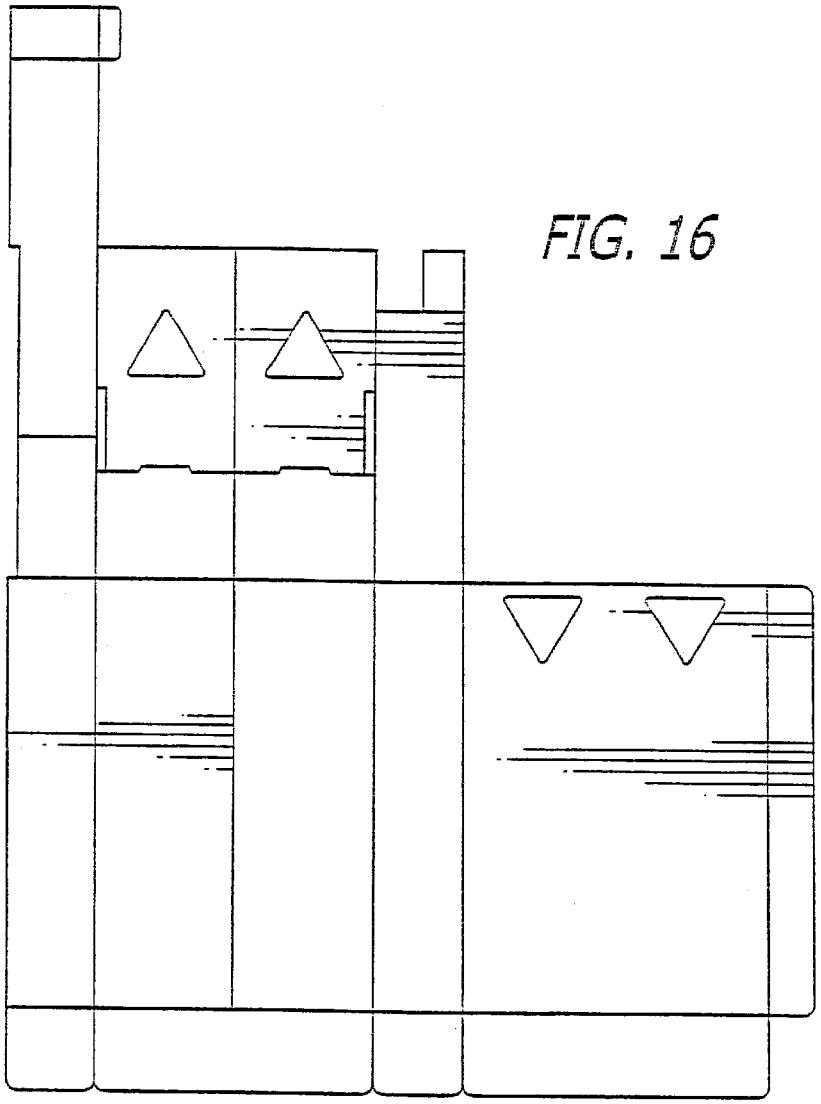
FIG. 16 illustrates the front side of the package blank of FIG. 15, which is the exterior of the package once the package is folded.
Figure 18:
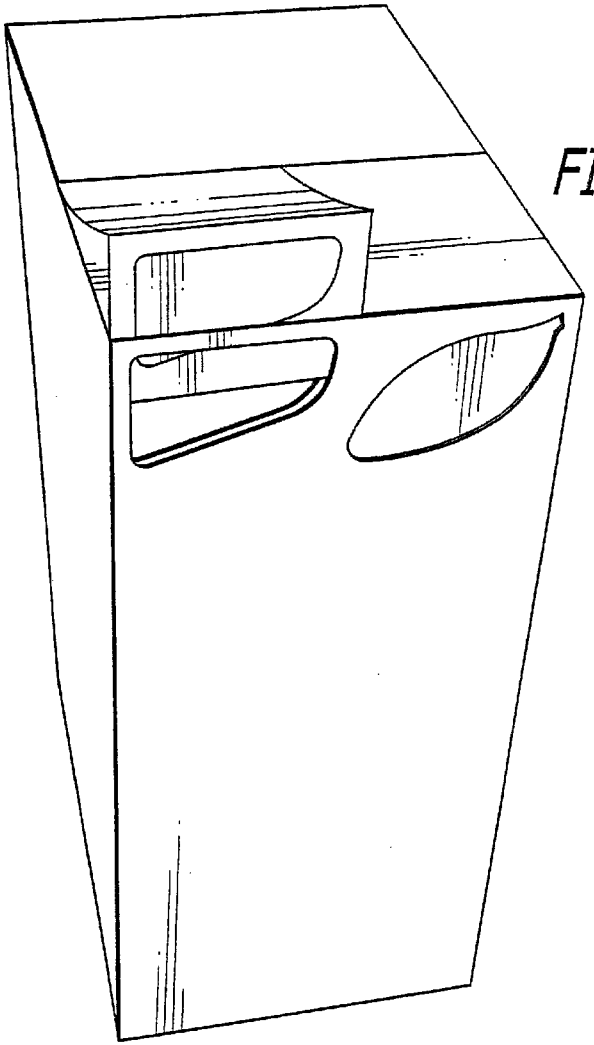
FIG. 18 is a view of the package of FIG. 17, with one slide partially raised in order to partially open one opening.
Figure 17:
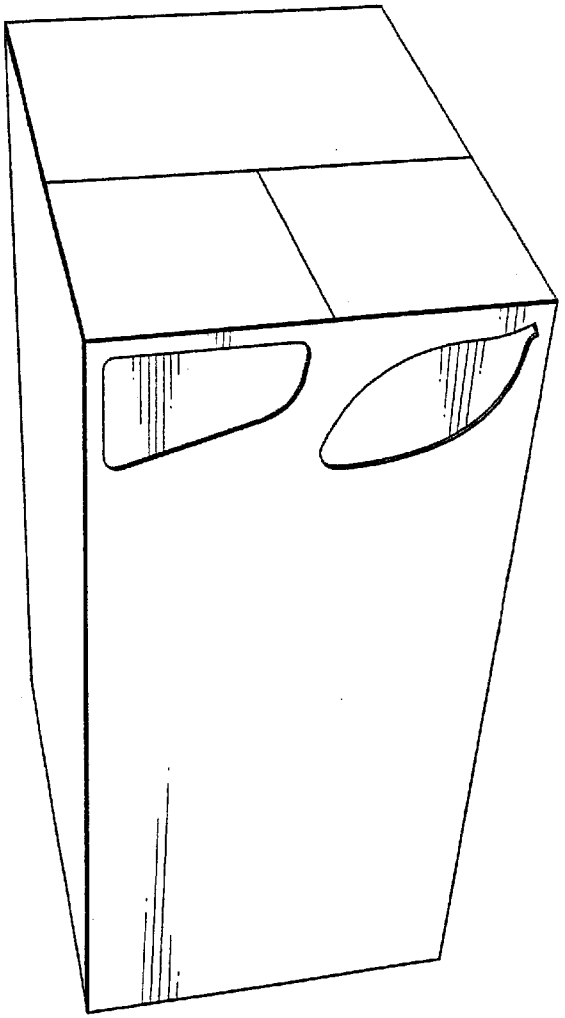
FIG. 17 is a side view of another alternative package design having two separate openings.
Figure 20:
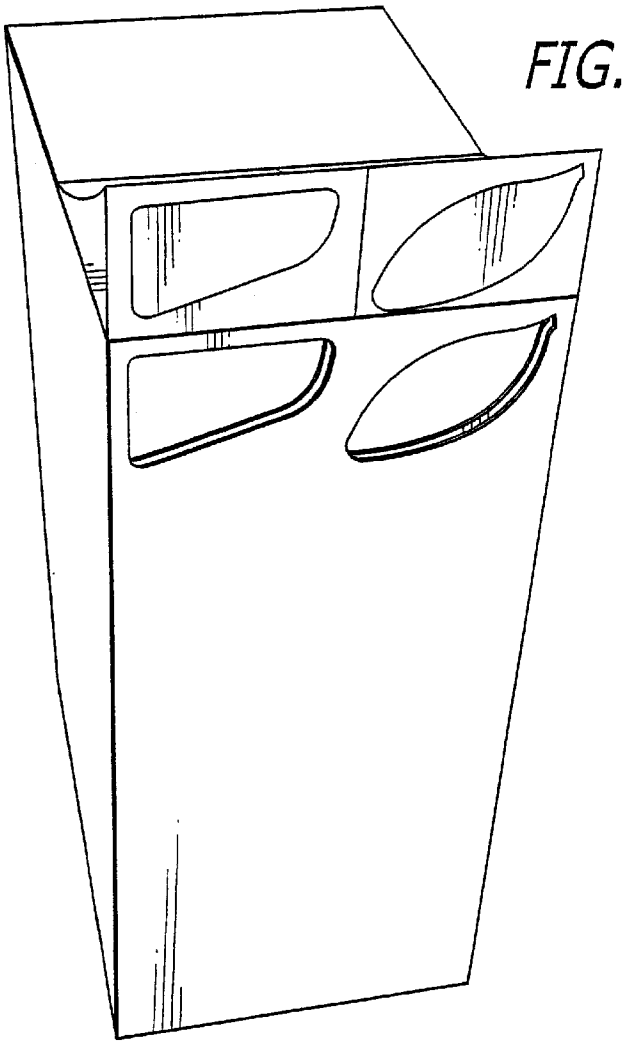
FIG. 20 illustrates both slides in the package of FIG. 18 fully raised, so as to open both openings in the package of FIGS. 17–19.
Figure 19:
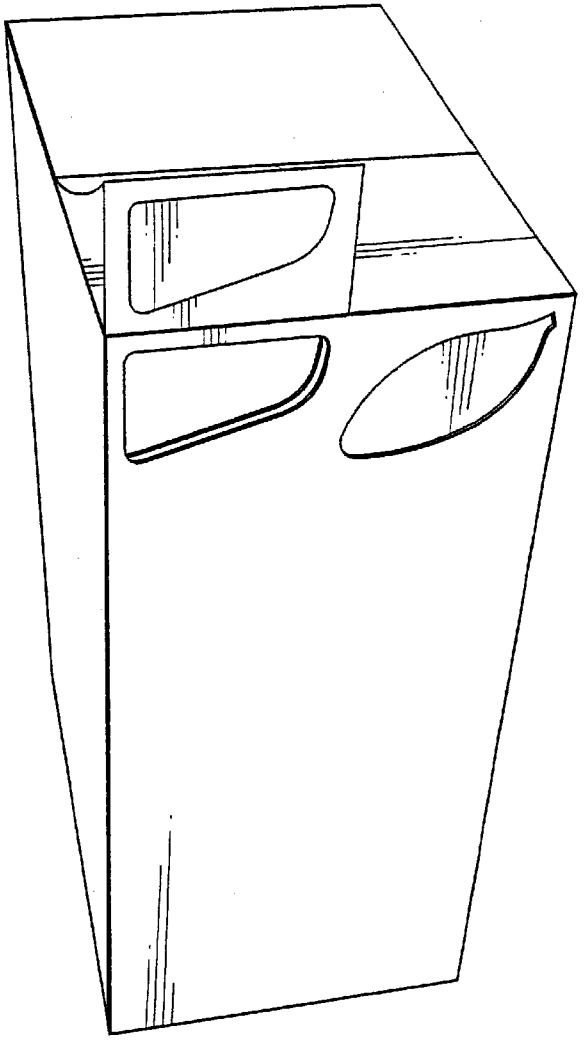
FIG. 19 illustrates the slide that is partially raised in FIG. 18 in a fully open position, to fully open one package opening.
Figure 22:
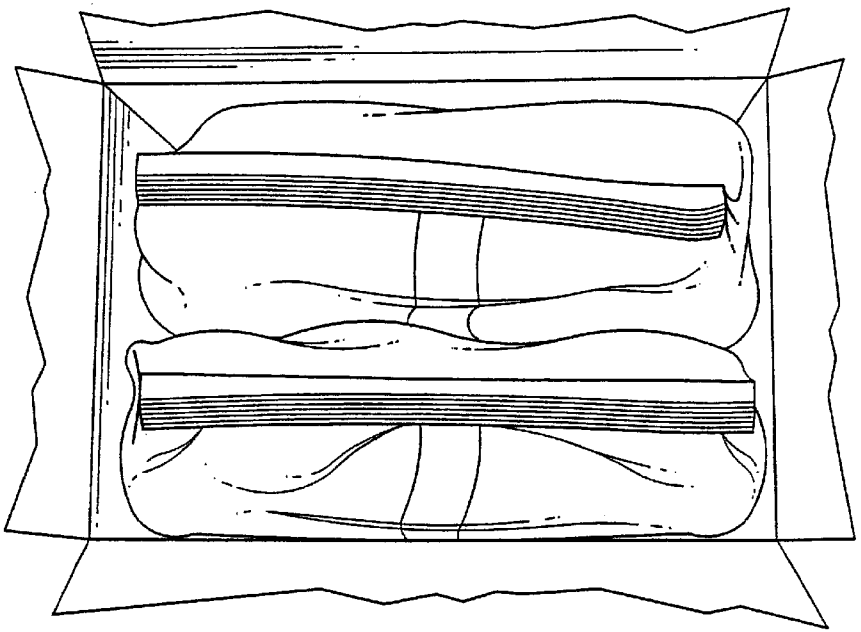
FIG. 22 illustrates the interior of the package of FIGS. 17–21, with two separate product bags within the interior.
Figure 21:
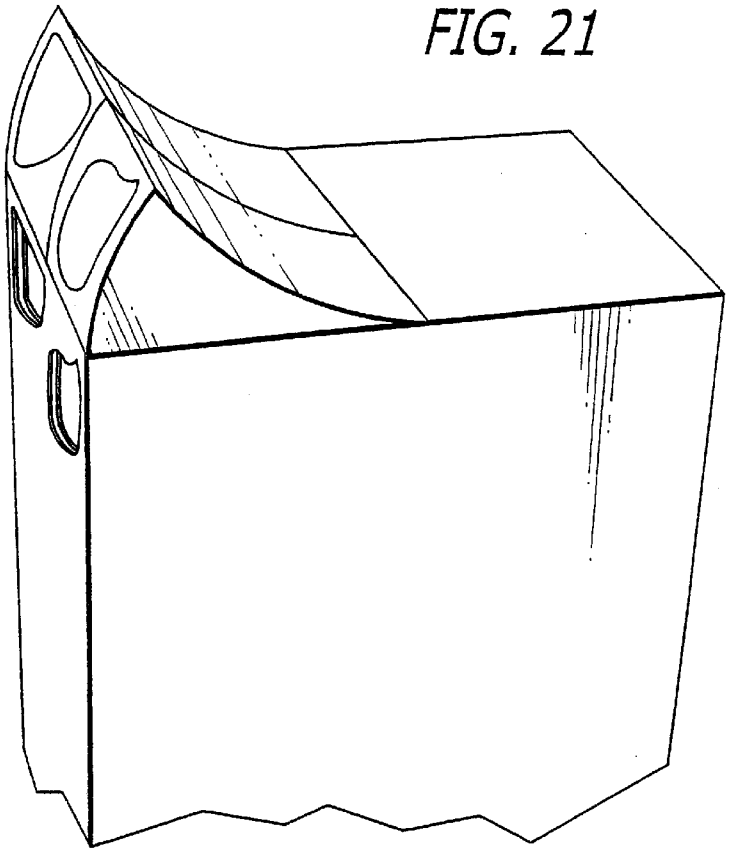
FIG. 21 is a side view of the package illustrated in FIG. 20, with both of the slides in the raised position.
Figure 25:
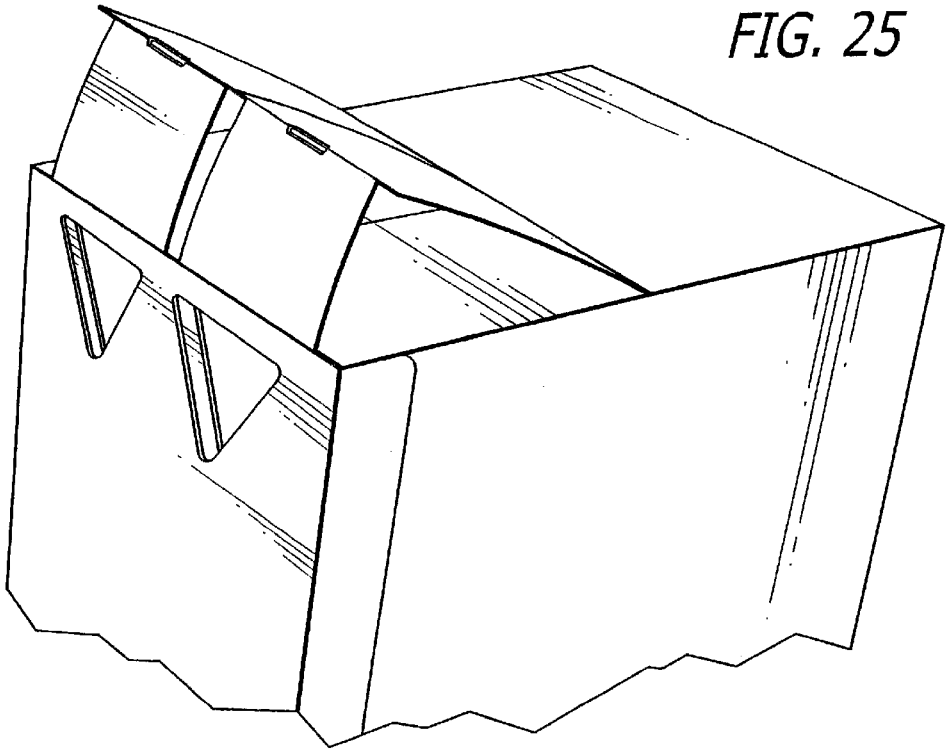
FIG. 25 is a perspective view of the package of FIG. 24 in which both slides are raised to open both package openings.
Figure 26:
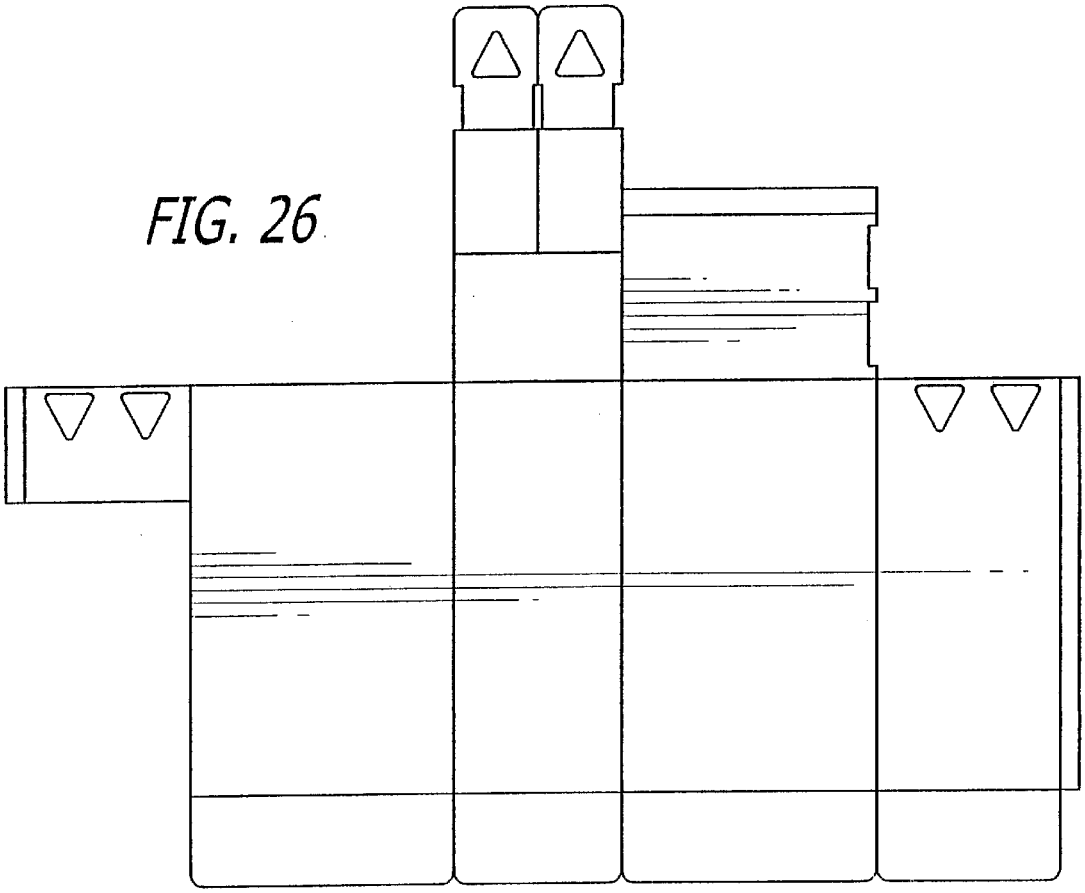
FIG. 26 is a front view of the package blank from which the package of FIG. 25 is formed by applying adhesive in the appropriate areas and then folding the blank.
Figure 27:
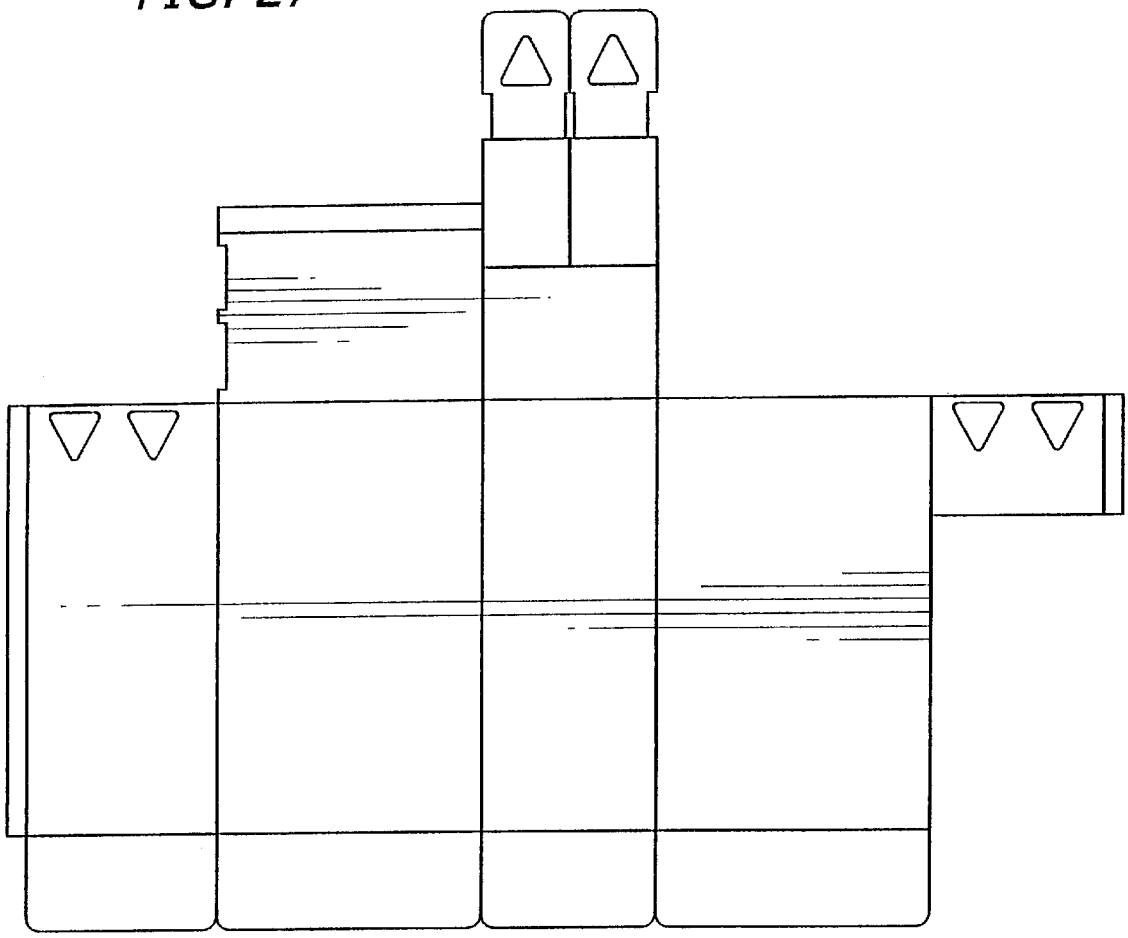
FIG. 27 is a rear view of the package blank of FIG. 26, which will become the interior of the package once the package is formed.

Referring again to FIG. 8, the opening can have any shape, such as circle 70, triangle 72, or L-shape 74. A wide range of opening shapes and sizes is available. FIG. 10 illustrates that the openings in the box may have a shape to correspond with the shape of the opening in the bag.

The box and the bag may each have more than one opening. The slide may have a plurality of openings, too, so that in the open position, several box openings are opened simultaneously. Alternatively, the openings in the slide may be such that sliding the slide a certain distance opens less than all of the box openings. With further sliding, one or more additional openings may be opened. As a further alternative, the box and bag may be provided with several openings, while the slide is provided with only one opening. The slide opening can then be moved from box opening to box opening, allowing the user to choose from which opening to pour.

Figure 9:
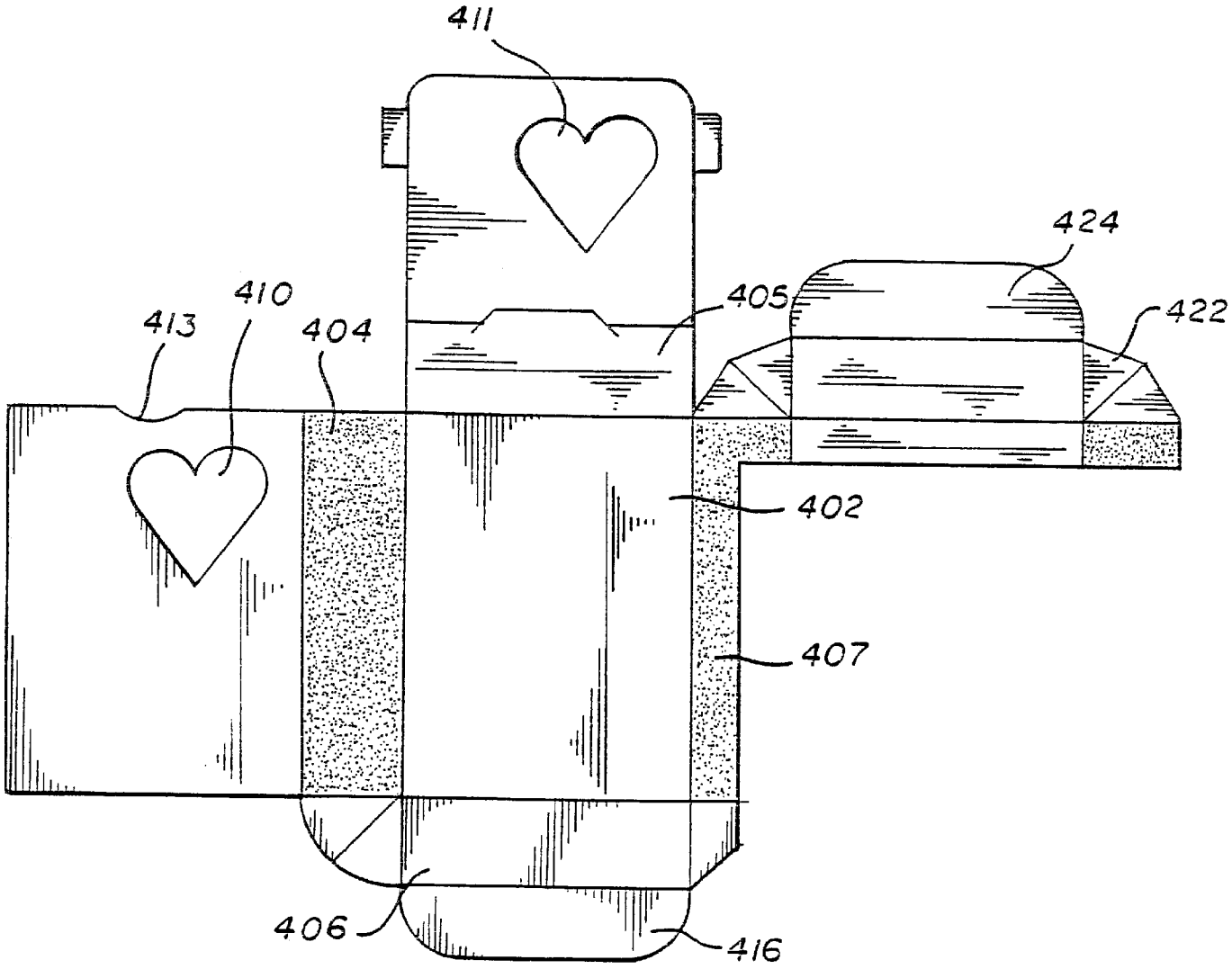
FIG. 9 illustrates a blank from which another alternative embodiment of the present invention is formed, this embodiment having a heart-shaped opening.

FIG. 9 illustrates an alternative embodiment of the present invention in which the various components are numbered consistently with the numbering of FIG. 1, with 400 added. In FIG. 9 the box openings 410 and 411 are heart-shaped, rather than the elongated, narrow shape of opening 10 in FIG. 3. If an inner bag is used inside the box, the bag may also have a heart-shaped opening.

The box of FIG. 9 has a portion 422 that folds inside of the box. The lower portion of 422 may be glued in place to secure the blank into a box. Relatively little material is required to form the right hand side of the blank illustrated in FIG. 9, and the embodiment of FIG. 9 is particularly material-efficient.

FIG. 10 illustrates one embodiment of a bag 150 that is compatible with the box of FIG. 9. The bag of FIG. 10 has a removable heart-shaped area 152 defined by one or more lines of weakness, preferably perforations. The position of the heart-shaped area 152 corresponds with heart-shaped opening 410 in the box of FIG. 9. The bag 150 may be glued in place at the bottom of the bag 160 or else where the box to align the heart shaped area 152 with box opening 410.

The embodiments of the present invention may be formed from a wide variety of materials. The presently-preferred material is sulfate cellulose cardboard. However, the box may alternatively be made of plastic or wax. Other materials such as paper and wood may also be utilized to form part or all of the box in special embodiments.

In a further embodiment, the box opening and/or the slide opening may be sealed with a small sheet of plastic, wax paper, or other sealing material. The small sheet may be adhered about the edges of the opening with an adhesive, or otherwise attached to the box. The small sheet may be perforated or provided with lines of weakness to define a removable portion, which the user removes before dispensing the contents of the box. A tab or tear strip may be provided on the sealing sheet to assist in removing the removable portion. Alternatively, the sheet may be a sticker that the user peels away rather than tearing. This embodiment may be used without an inner liner with some pourable products, such as powdered dishwasher soap and rice, to name just a few.

In a further alternative embodiment, a bag is provided with a zipper or other known sliding closure system. In this embodiment, the user slides the closure to an open position rather than tearing along a line of weakness. The bag can then be re-sealed by sliding the closure to a shut position.

The present application addresses numerous other inventions, including alternative package designs that may be used with or without inner liners as described above. These alternative package designs are generally illustrated in FIGS. 11–27. For example, the packages may have two or more independent openings. Separate slides may be provided for each of the openings, such that each opening may be open and/or shut independently of the other(s). The package may be provided with a stop so that the user cannot accidentally pull the slide(s) all the way out of the package by accident. That is, when the slide reaches the fully open position, the stop prevents the slide from opening further.

A multiple-opening package may have one or more compartment separators. With independent compartments, different products may be stored within the package. The user can open one opening to dispense one of the products, without opening the other opening(s) to dispense the other products.

In another alternative package design, the package may have two or more openings, with two or more corresponding inner liners within the package to store different products. When the inner liners are bags, the use of a compartment separator within the package is optional, since the bags themselves serve to keep the products separate.

Other features may be incorporated into the package design. The liner may have a removable portion, defined by one or more lines of weakness or by other means such as a removable sticker. The removable portion of the liner is aligned with the box opening.

The system can optionally include a cartridge, into which the liner is affixed, for insertion into the box. The cartridge serves to maintain the liner in the proper position within the box.

As another option, the system can include a sound module. As the box is opened, the sound module is activated. The sound module can play music, an advertising message, and/or any combination of sounds for that sound modules can generate.

In one particular embodiment of the invention, a system for conveniently storing and dispensing pourable items has a front wall with an opening and an inside surface, a back wall, a first and a second side wall, a top and a bottom flap and a slide that is in contact with the inside surface of the front wall, said slide having an opening. The front wall, back wall, first and second side walls, and top and bottom flaps are interconnected so as to form a box. The slide is movable between an open position in which the slide opening substantially aligns with the front wall opening and a closed position in which said slide opening is entirely out of alignment with the front wall opening, thereby closing the box. An inner liner inside said box has a removable area defined by one or more lines of weakness. The removable area is positioned adjacent to at least a portion of the front wall opening. The system also has a retaining cartridge for the inner liner. The package may have more than one opening and corresponding slide, in which case multiple inner liners and retaining cartridges may be used. Alternatively, a single retaining cartridge that retains multiple inner liners may be used.

Related embodiments may have one or more other features. The bag may include lines of weakness, which may be perforations. Alternatively, instead of lines of weakness, the bag may simply be made of a material through which the user can cut an opening with a knife or other cutting tool. The cartridge may have four sides, three sides, or even two sides. A one-sided cartridge is also possible. The system may include a liner retention band that typically extends about the cartridge, to hold the bag within the cartridge. The system may include a sound module. In one embodiment, the sound module is activated when the slide is lifted into the open position, to play sounds that have been stored within the module, such as voices, music and the like. In another embodiment, graphics are printed on the slide such that when the slide is in the closed position, the graphics are visible through the opening in box.

It should be noted that the relative dimensions of the drawings are approximate. The drawings are intended to convey general concepts and are not precise engineering drawings. The particular dimensions of the various embodiments may be adjusted as necessary. For example, but not limitation, the openings 210 and 315 in FIGS. 4 and 5, respectively, may be made proportionately larger or smaller in particular embodiments of the box, as can the various other openings in the boxes and bags.

Accordingly, the present invention is not limited precisely to the arrangements as shown in the drawings and as described in detail hereinabove.

What is claimed is:

1. A multi-compartment assembly for conveniently storing and dispensing pourable items comprising:

a front wall;

a back wall;

a first side wall and a second side wall;

a top and a bottom flap first and second slides that are in contact with the inside surface of the front wall;

said front wall having at least one opening;

wherein said front wall, said back wall, said first and second side walls, and said top and bottom flaps are interconnected so as to form a box, said first slide being movable between an open position in which said first slide does not cover said front wall opening and a closed position in which said first slide covers said front wall opening;

said assembly including an intermediate wall dividing said box into at least two compartments, each of said slides being associated respectively with a compartment; and at least three of the walls of at least one of said compartments being formed of only a single thickness of the sheet material from which said box is formed.

2. An assembly as defined in claim 1 wherein said front wall has first and second openings, said first and second slides being associated with said first and second opening, respectively, and wherein each of said first and second slides are movable between an open position in which the slide does not cover the associated opening and a closed position in which the slide covers the associated opening.

3. An assembly as defined in claim 2 wherein said slides are provided with openings which align with openings in said front wall when said slides are in the open position.

4. An assembly as defined in claim 1 wherein said assembly forms a tube type box whereby it may be readily filed from the bottom.

5. A multi-compartment assembly for conveniently storing and dispensing pourable items comprising:

a front wall;

a back wall;

a first side wall and a second side wall;

a top and a bottom flap a plurality of slides that are in contact with the inside surface of the front wall;

said front wall having at least one opening;

wherein said front wall, said back wall, said first and second side walls, and said top and bottom flaps are interconnected so as to form a box, one of said slides being movable between an open position in which said one slide does not cover said front wall opening and a closed position in which said one slide covers said front wall opening;

said assembly including at least one wall separating said box into a plurality of compartments, each of said slides being associated with a compartment; and each said slide having a cut away area forming a stop which engages said top flap to restrain said stop at a desired location with said opening being open to dispense products.

6. An assembly as defined in claim 5 wherein said slides are provided with openings which align with openings in said front wall when said slides are in the open position.

7. An assembly as defined in claim 5 wherein said assembly forms a tube type box whereby it may be readily filled from the bottom.

8. A multi-compartment assembly for conveniently storing and dispensing pourable items comprising:

a front wall;

a back wall;

a first side wall and a second side wall;

a bottom flap and at least one top flap;

a plurality of slides that are in contact with the inside surface of the front wall;

said front wall having at least two openings;

wherein said front wall, said back wall, said first and second side walls, and said top and bottom flaps are interconnected so as to form a compartmented box, with each compartment associated with a front wall opening and a slide, each said slide being movable between an open position in which said slide does not cover the associated front wall opening and a closed position in which said slide covers the associated front wall opening;

said slides being foldingly connected to the top of said box and each slide having an opening;

said slides having integral stops formed therein to align said openings as said slides are moved; and each of said front wall, said back wall and at least one of said side walls of said box including at least some areas with only one thickness of sheet material from which said box is formed.

9. A multi-compartment assembly for conveniently storing and dispensing pourable items comprising:

a front wall;

a back wall;

a first side wall and a second side wall;

a bottom flap and at least one top flap;

a plurality of slides, each in contact with the inside surface of one of said walls;

said walls having at least two openings;

wherein said front wall, said back wall, said first and second side walls, and said top and bottom flaps are interconnected so as to form a compartmented box, with each compartment associated with a wall opening and a slide, each said slide being movable between an open position in which said slide does not cover the associated wall opening and a closed position in which said slide covers the associated front wall opening;

said slides being foldingly connected to the top of said box and each slide having an opening;

said slides having integral cutaway stops formed therein to engage at least one of said top flaps, to align said openings as said slides are opened; and each of said front, back and side walls of said box including at least some areas with only one thickness of sheet material from which said box is formed.

* * * * *